US009956584B2

(12) United States Patent
Feygelman

(10) Patent No.: US 9,956,584 B2
(45) Date of Patent: May 1, 2018

(54) TO APPLY A COATING TO MEDIA

(71) Applicant: Hewlett-Packard Indigo B.V., Amstelveen (NL)

(72) Inventor: Alex Feygelman, Petach-Tiqwa (IL)

(73) Assignee: HP Indigo B.V., Amstelveen (NL)

( * ) Notice: Subject to any disclaimer, the term of this patent is extended or adjusted under 35 U.S.C. 154(b) by 0 days. days.

(21) Appl. No.: 15/266,019

(22) Filed: Sep. 15, 2016

(65) Prior Publication Data

US 2017/0001215 A1 Jan. 5, 2017

Related U.S. Application Data

(63) Continuation of application No. 14/374,830, filed as application No. PCT/EP2012/051608 on Jan. 31, 2012, now Pat. No. 9,468,945.

(51) Int. Cl.

| | |
|---|---|
| ***B05D 1/28*** | (2006.01) |
| ***B05C 1/02*** | (2006.01) |
| ***B05C 9/10*** | (2006.01) |
| ***B05D 5/04*** | (2006.01) |
| ***B41J 11/00*** | (2006.01) |
| ***B41F 19/00*** | (2006.01) |
| ***G03G 15/16*** | (2006.01) |
| *B41M 5/00* | (2006.01) |
| *B41M 7/00* | (2006.01) |

(52) U.S. Cl.

CPC ..... *B05D 1/28* (2013.01); *B05C 1/025* (2013.01); *B05C 9/10* (2013.01); *B05D 5/04* (2013.01); *B41F 19/002* (2013.01); *B41J 11/0015* (2013.01); *G03G 15/1695* (2013.01); *B05D 2203/22* (2013.01); *B41J 11/0025* (2013.01); *B41M 5/0011* (2013.01); *B41M 7/0027* (2013.01); *B41M 7/0036* (2013.01); *B41M 7/0045* (2013.01); *B41M 7/0054* (2013.01)

(58) Field of Classification Search

None

See application file for complete search history.

(56) References Cited

U.S. PATENT DOCUMENTS

| | | | |
|---|---|---|---|
| 2,069,789 | A | 2/1937 | Von Webern Guido |
| 2,558,689 | A | 6/1951 | Miller |
| 4,292,827 | A | 10/1981 | Waugh |
| 5,335,596 | A | 8/1994 | DeMoore et al. |

(Continued)

FOREIGN PATENT DOCUMENTS

| | | |
|---|---|---|
| CN | 1750886 | 3/2006 |
| CN | 101417531 | 4/2009 |

(Continued)

OTHER PUBLICATIONS

The European Patent Office, International Search Report and Written Opinion dated Oct. 15, 2012 issued on PCT Patent Application No. PCT/EP2012/051608 (11 pages).

*Primary Examiner* — Jethro M Pence

(74) *Attorney, Agent, or Firm* — HP Inc. Patent Department

(57) ABSTRACT

In some examples, an apparatus to apply a coating to a media includes a first roller to receive a continuous belt that is to receive a coating from a second roller and to transfer the coating to the media, the first roller having a variable dimension to provide an adjustable width of the continuous belt to the second roller.

11 Claims, 7 Drawing Sheets

(56) References Cited

U.S. PATENT DOCUMENTS

| | | | | |
|---|---|---|---|---|
| 6,070,047 | A | 5/2000 | Ichinose | |
| 6,110,093 | A | 8/2000 | Slusarz | |
| 6,546,867 | B1 | 4/2003 | Franklin et al. | |
| 7,215,915 | B2 | 5/2007 | Baskin et al. | |
| 7,320,281 | B2 | 1/2008 | Becker et al. | |
| 7,761,025 | B2 | 7/2010 | Sato | |
| 2002/0014172 | A1* | 2/2002 | Fujiwara ..... | B41F 31/15<br>101/350.3 |
| 2007/0068406 | A1 | 3/2007 | Hartmann et al. | |

FOREIGN PATENT DOCUMENTS

| | | | |
|---|---|---|---|
| CN | 101573235 | | 11/2009 |
| CN | 101883639 | | 11/2010 |
| CN | 102112313 | | 6/2011 |
| CN | 102191723 | | 9/2011 |
| DE | 10 2009 032 509 | A1 | 1/2011 |
| EP | 1 208 978 | A1 | 5/2002 |
| KR | 100817282 | | 3/2008 |

* cited by examiner

TO APPLY A COATING TO MEDIA

CROSS REFERENCE TO RELATED APPLICATIONS

This is a continuation of U.S. application Ser. No. 14/374,830, filed Jul. 25, 2014, which is a national stage application under 35 U.S.C. § 371 of PCT/EP2012/051608, filed Jan. 31, 2012, which are both hereby incorporated by reference in their entirety.

BACKGROUND

Printing systems may include an apparatus for coating media (such as paper) with a primer prior to printing. A primer may be provided to improve adhesion between the media and the printing ink.

A person may wish to use such a printing system to print on media having different dimensions and this may result in primer being applied to only a portion of the media. Alternatively, this may result in primer being applied around the media and thus being applied to other components of the printing system.

BRIEF DESCRIPTION

Reference will now be made by way of example only to the accompanying drawings in which.

DETAILED DESCRIPTION

In the following description, the wording 'connect' and 'couple' and their derivatives mean operationally connected or coupled. It should be appreciated that any number or combination of intervening components can exist (including no intervening components).

Figure 1:
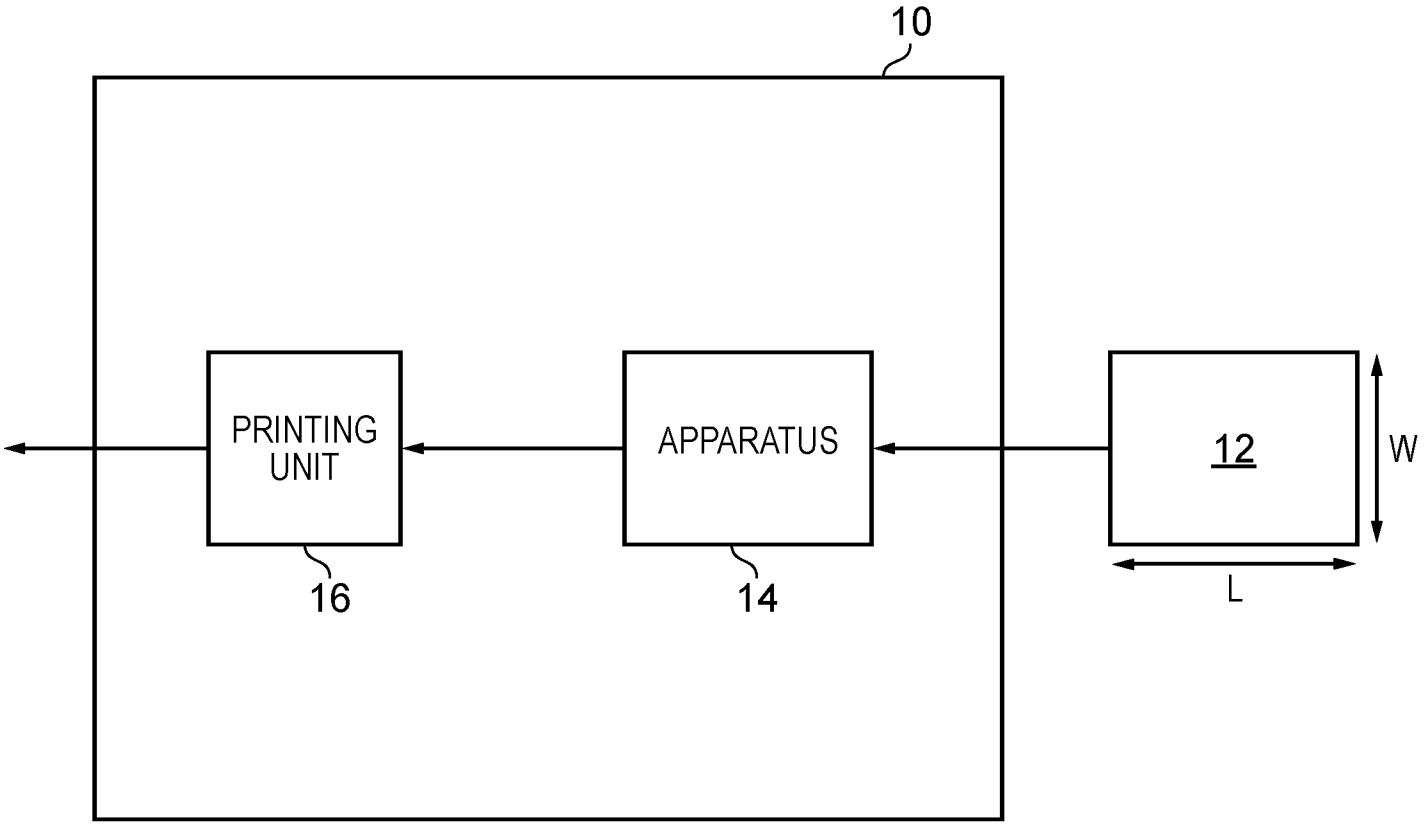
FIG. 1 illustrates a schematic diagram of a printing system according to an example of the invention.

FIG. 1 illustrates a schematic diagram of a printing system 10 and media 12. The printing system 10 includes an apparatus 14 and a printing unit 16.

The apparatus 14 is arranged to receive the media 12 and apply a coating (such as priming layer, for example) to the media 12. The apparatus 14 is described in greater detail in the following paragraphs with reference to FIGS. 2, 3, 4, 5, 6 and 7.

The printing unit 16 is arranged to receive the media 12 from the apparatus 14 and apply ink to the media 12. The apparatus 14 and the printing unit 16 may be positioned adjacent one another with no other intervening components of the printing system 10 between them. Consequently, the coating on the media 12 may be relatively fresh when the printing unit 16 applies ink to the media 12.

Alternatively, there may be one or more other components of the printing system 10 positioned between the apparatus 14 and the printing unit 16.

The media 12 may be any suitable media and may be a web of media or a sheet of media (such as paper) for example. The media 12 has a width W and a length L. It should be appreciated that the media 12 may have any width and length. For example, the media 12 may have A4 dimensions (where the width is 210 mm and the length is 297 mm) or A3 dimensions (where the width is 297 mm and the length is 420 mm).

Figure 2:
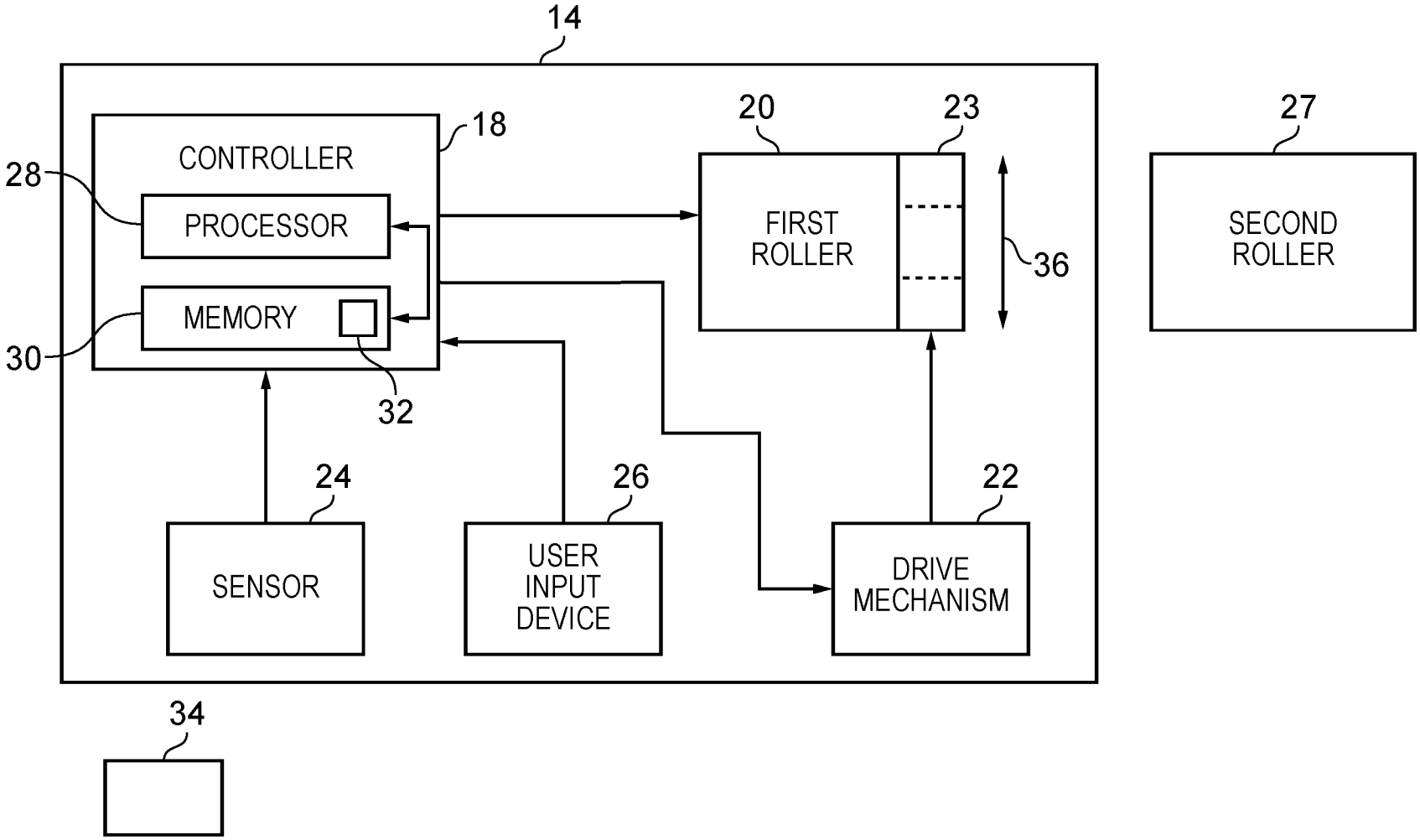
FIG. 2 illustrates a schematic diagram of an apparatus for applying a coating to media according to an example of the invention.

FIG. 2 illustrates a schematic diagram of apparatus 14 according to an example. The apparatus 14 includes a controller 18, a first roller 20, a drive mechanism 22, a continuous belt 23, a sensor 24, a user input device 26 and a second roller 27.

The apparatus 14 may be a module. As used here, 'module' refers to a unit or apparatus that excludes certain parts/components that would be added by an end manufacturer or a user. For example, the apparatus 14 may not include the controller 18, and/or the drive mechanism 22, and/or the continuous belt 23, and/or the sensor 24, and/or the user input device 26 and/or the second roller 27.

The implementation of the controller 18 can be in hardware alone (for example, a circuit, a processor and so on), have certain aspects in software including firmware alone or can be a combination of hardware and software (including firmware).

The controller 18 may be implemented using instructions that enable hardware functionality, for example, by using executable computer program instructions in a general-purpose or special-purpose processor that may be stored on a computer readable storage medium (disk, memory etc) to be executed by such a processor.

In various examples, the controller 18 may include a processor 28 and a memory 30. The processor 28 is configured to read from and write to the memory 30. The processor 28 may also comprise an output interface via which data and/or commands are output by the processor 28 and an input interface via which data and/or commands are input to the processor 28.

The memory 30 stores a computer program 32 comprising computer program instructions that control the operation of the apparatus 14 when loaded into the processor 28. The computer program instructions 32 provide the logic and routines that enables the apparatus 14 to perform the methods illustrated in FIGS. 7 and 8. The processor 28 by reading the memory 30 is able to load and execute the computer program 32.

The computer program may arrive at the apparatus 14 via any suitable delivery mechanism 34. The delivery mechanism 34 may be, for example, a non-transitory computer-readable storage medium, a computer program product, a memory device, a record medium such as a compact disc read-only memory (CD-ROM) or digital versatile disc (DVD), an article of manufacture that tangibly embodies the computer program 32. The delivery mechanism 34 may be a signal configured to reliably transfer the computer program 32.

Although the memory 30 is illustrated as a single component it may be implemented as one or more separate components some or all of which may be integrated/removable and/or may provide permanent, semi-permanent, dynamic, or cached storage.

References to 'computer-readable storage medium', 'computer program product', 'tangibly embodied computer program' etc. or a 'controller', 'computer', 'processor' etc. should be understood to encompass not only computers having different architectures such as single or multi-processor architectures and sequential (Von Neumann) or parallel architectures but also specialized circuits such as field-programmable gate arrays (FPGA), application specific circuits (ASIC), signal processing devices and other processing circuitry. References to computer program, instructions, code etc. should be understood to encompass software for a programmable processor or firmware such as, for example, the programmable content of a hardware device whether instructions for a processor, or configuration settings for a fixed-function device, gate array or programmable logic device etc.

As used in this application, the term 'circuitry' refers to all of the following:

(a) hardware-only circuit implementations (such as implementations in only analog and/or digital circuitry) and (b) to combinations of circuits and software (and/or firmware), such as (as applicable): (i) to a combination of processor(s) or (ii) to portions of processor(s)/software (including digital signal processor(s)), software, and memory(ies) that work together to cause an apparatus, such as a mobile phone or server, to perform various functions) and (c) to circuits, such as a microprocessor(s) or a portion of a microprocessor(s), that require software or firmware for operation, even if the software or firmware is not physically present.

This definition of 'circuitry' applies to all uses of this term in this application, including in any claims. As a further example, as used in this application, the term "circuitry" would also cover an implementation of merely a processor (or multiple processors) or portion of a processor and its (or their) accompanying software and/or firmware.

The sensor 24 is arranged to sense at least one dimension of the media 12 (such as the width and/or the length of the media 12) and provide the sensed dimension to the controller 18.

The user input device 26 is arranged to receive a user input including information indicative of at least one dimension of the media 12 (such as the width and/or the length of the media 12) and to provide the user input information to the controller 18. The user input device 26 may be any suitable user input device and may be for example, a keypad, a keyboard, a touchpad or a touch screen display.

The dimensions of the media 12 may be provided to the controller 18 from the sensor 24 and/or from the user input device 26. For example, where the apparatus 14 includes the sensor 24 but does not include the user input device 26, the dimensions of the media 12 may be provided from the sensor 24. By way of another example, where the apparatus 14 includes the user input device 26 and not the sensor 24, the dimensions of the media 12 may be provided from the user input device 26. By way of a further example, where the apparatus 14 includes the sensor 24 and the user input device 26, the dimensions of the media 12 may be provided by the sensor 24 and/or the user input device 26 (the sensor 24 may be used to verify the dimensions input by the user for example).

Figure 3:
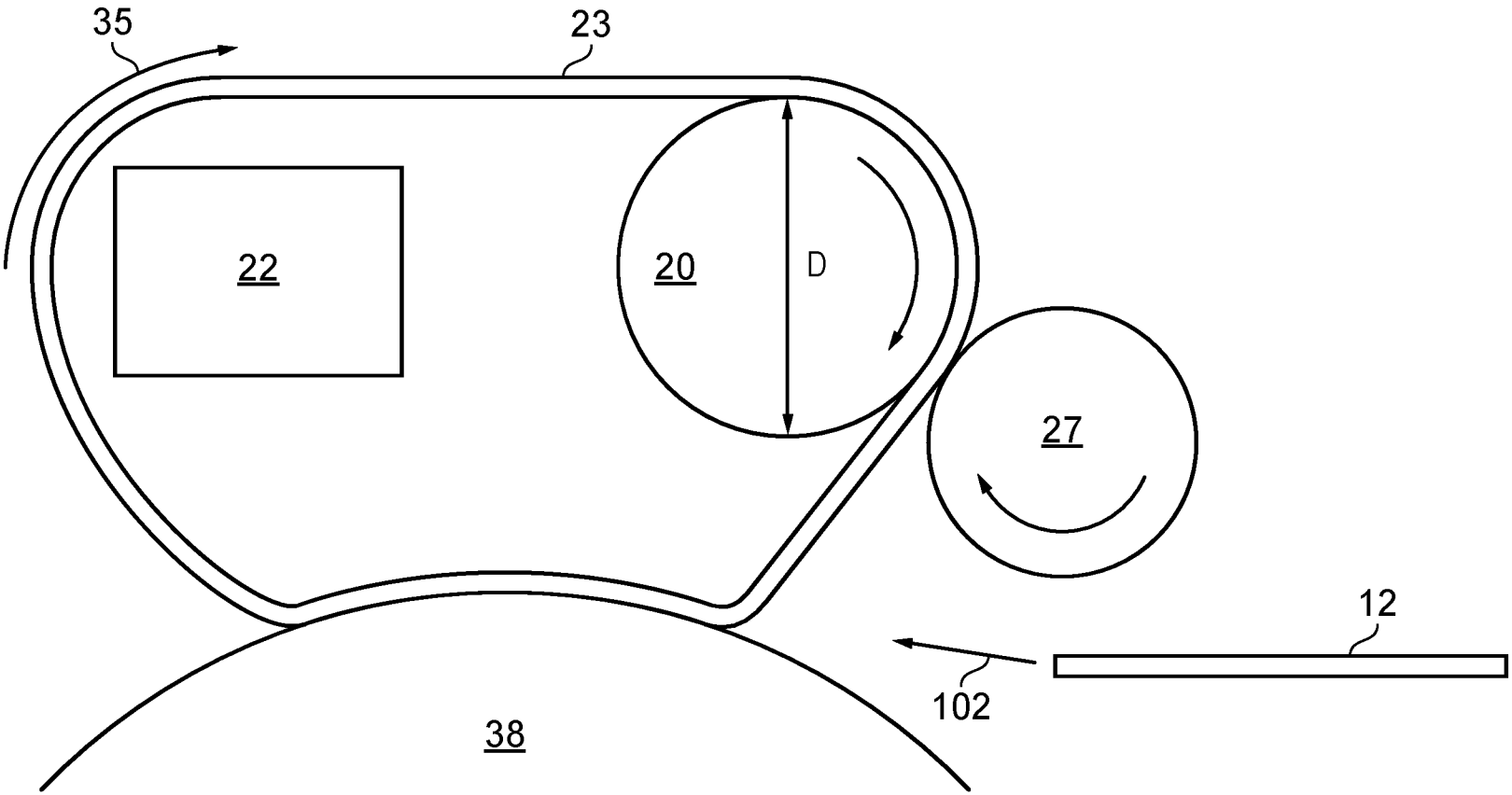
FIG. 3 illustrates a cross sectional side view of an apparatus according to an example of the invention.
Figure 4:
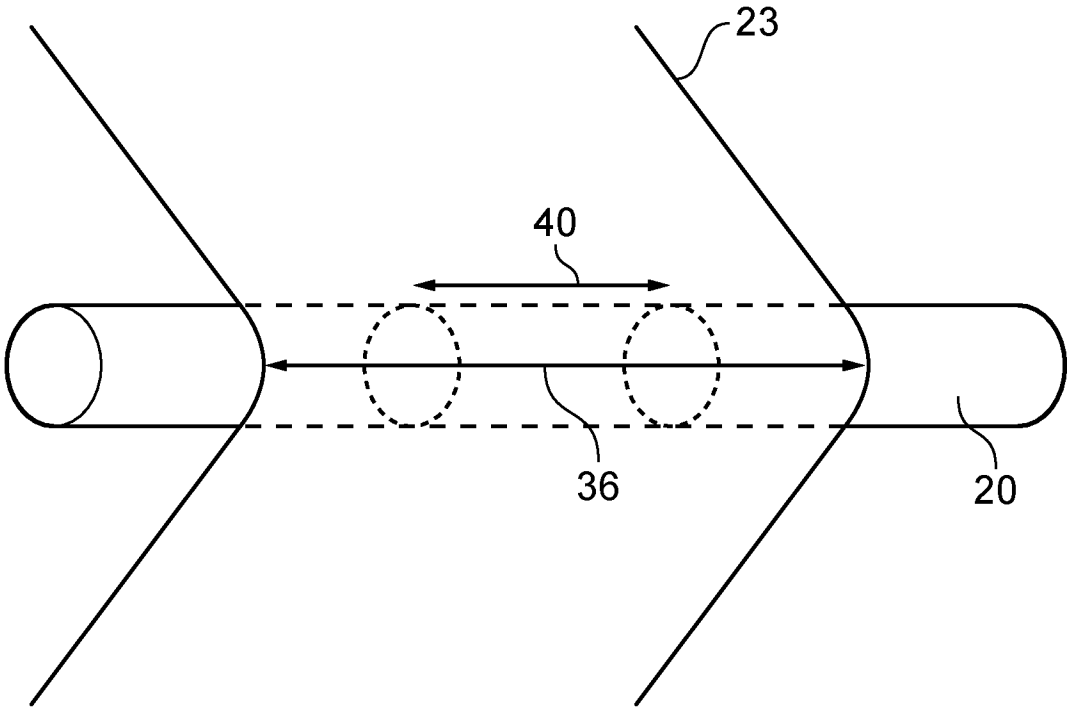
FIG. 4 illustrates a perspective view of a first roller and a continuous belt according to an example of the invention.

With reference to FIGS. 2, 3 and 4 the continuous belt 23 is provided around the drive mechanism 22 and the first roller 20. The continuous belt 23 may be any suitable belt for receiving a coating and for transferring the coating to the media 12. The continuous belt 23 may comprise any suitable materials and in various examples, the continuous belt 23 is relatively elastic.

The drive mechanism 22 is arranged to move the continuous belt 23 in a clockwise direction as indicated by arrow 35 so that the continuous belt 23 moves between the first roller 20 and the second roller 27 and over an impression drum 38 (which may or may not be part of the apparatus 14). In various examples, the drive mechanism 22 includes a motor, a drive shaft and a plurality of rollers for driving and guiding the movement of the continuous belt 23. The controller 14 is arranged to control the drive mechanism 22 and thus the movement of the continuous belt 23.

The second roller 27 is arranged to provide a coating (such as a priming layer) to the continuous belt 23 and may, in one example, be a reverse kiss gravure roller. The second roller 27 may include a container that stores the coating and provides the coating to the surface of the second roller 27. In other examples, the second roller 27 may not include a container that stores the coating and may receive the coating from a container within the printing system 10.

The first roller 20 is positioned adjacent the second roller 27 and is arranged to provide an adjustable width (indicated by arrow 36 in FIGS. 2 and 4) of the continuous belt 23 to the second roller 27. In various examples, the controller 18 is configured to control the first roller 20 to provide an adjustable width of the continuous belt 23 to the second roller 27.

The first roller 20 may have a variable width (which may be a telescopic structure for example) that enables the first roller 20 to extend and contract in the direction of arrow 36 (for example, the first roller 20 may contract to have a width indicated by the reference numeral 40 in FIG. 4). In this example, the continuous belt 23 is pressed into contact with the second roller 27 along the width of the first roller 20 and therefore, the width of contact between the continuous belt 23 and the second roller 27 is substantially the same as the width of the first roller 20. Consequently, the continuous belt 23 receives a width of coating that corresponds to the width of the first roller 20.

In another example, the first roller 20 may have a variable diameter D along at least a portion of the width of the first roller 20 (which may, for example, be the structure illustrated in FIG. 6) that enables the outer surface of the first roller 20 to move towards and away from the second roller 27 (for example, the first roller 20 may expand in diameter along a width indicated by the reference numeral 40 in FIG. 4). In this example, the continuous belt 23 is pressed into contact with the second roller 27 along the width of the first roller 20 that has an increased diameter and therefore, the width of contact between the continuous belt 23 and the second roller 27 is substantially the same as the width of the first roller 20 that has an increased diameter. Consequently, the continuous belt 23 receives a width of coating that corresponds to the width of the first roller 20 that has an increased diameter.

Figure 5:
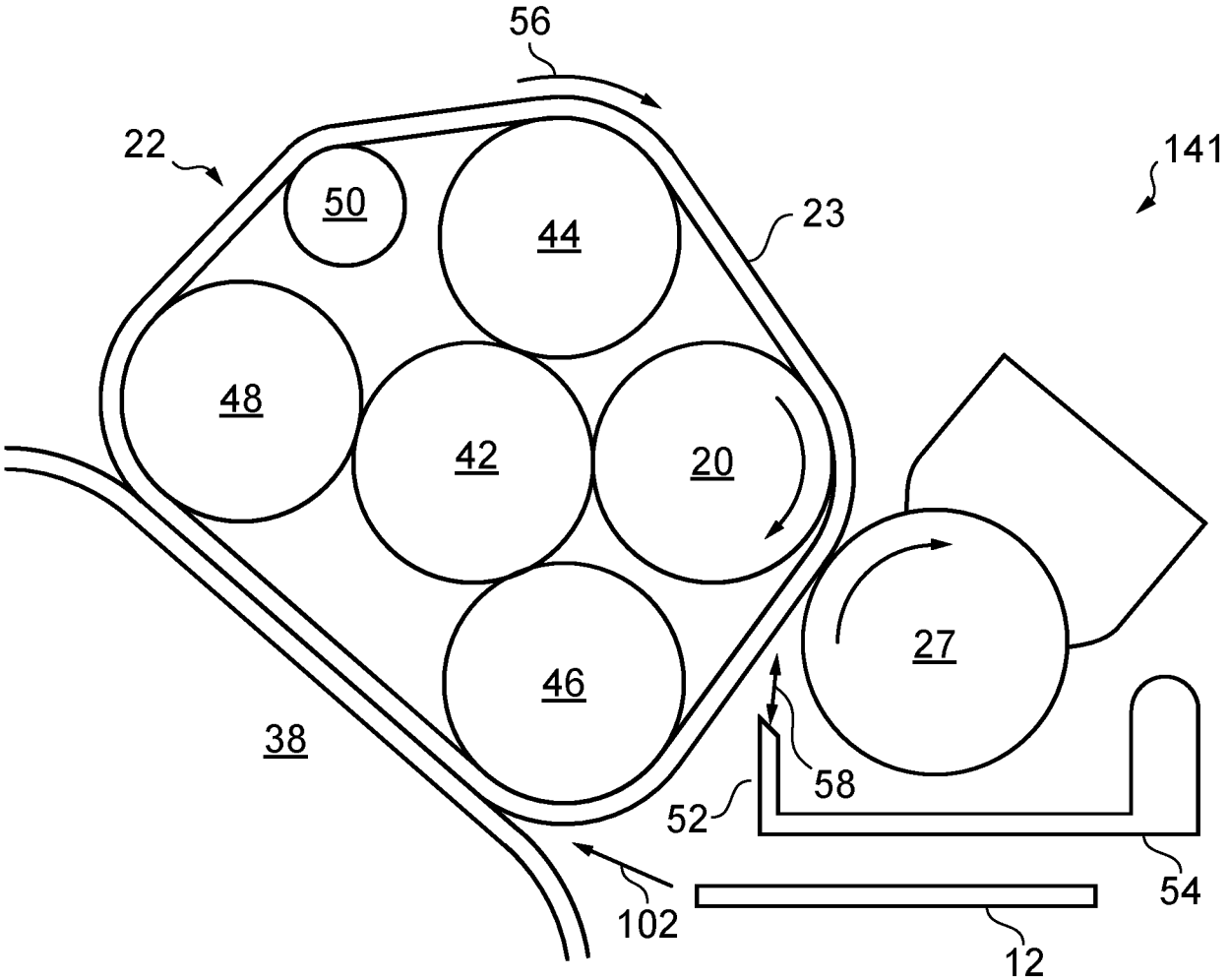
FIG. 5 illustrates a cross sectional side view of another apparatus according to an example of the invention.

FIG. 5 illustrates a cross sectional side view of another apparatus 141. The apparatus 141 is similar to the apparatus 14 illustrated in FIGS. 3 and 4 and where the features are similar, the same reference numerals are used. In this example, the drive mechanism includes a distribution shaft 42, a drive shaft 44, a first support roller 46, a second support roller 48, and a tension roller 50. The continuous belt 23 is positioned around the outer surfaces of the first roller 20, the first support roller 46, the second support roller 48, the tension roller 50 and the drive shaft 44. The apparatus 141 additionally includes a member 52 for moving the continuous belt 23 away from the second roller 27, and a drip tray 54.

The distribution shaft 42 is coupled to a motor and is arranged to drive at least the drive shaft 44 to rotate in a clockwise direction (as indicated by arrow 56). The drive shaft 44 is arranged to drive the continuous belt 23 and includes a plurality of grooves for increasing the friction between the drive shaft 44 and the continuous belt 23. The first support roller 46 and the second support roller 46 are arranged to support the continuous belt 23 where the continuous belt 23 contacts the impression drum 38. The tension roller 50 is arranged to maintain the continuous belt 23 at a predetermined tension and enable side shifting of the continuous belt 23.

The member 52 may be a doctor blade that is arranged to move in the direction indicated by arrow 58 and therefore into and out of the nip between the first roller 20 and the second roller 27. When the member 52 moves into the nip between the first roller 20 and the second roller 27, the member 52 moves the continuous belt 23 away from the second roller 27 and thereby prevents coating being applied to the continuous belt 23 by the second roller 27. Consequently, the member 52 is able to control the length of coating applied by the second roller 27 to the continuous belt 23. In various examples, the controller 18 is configured to control the movement of the member 52 into and out of nip between the first roller 20 and the second roller 27.

The drip tray 54 is arranged to collect coating that drips from the second roller 27 and may be integral with the member 52 (as illustrated in FIG. 5) or may be separate to the member 52.

Figure 6:
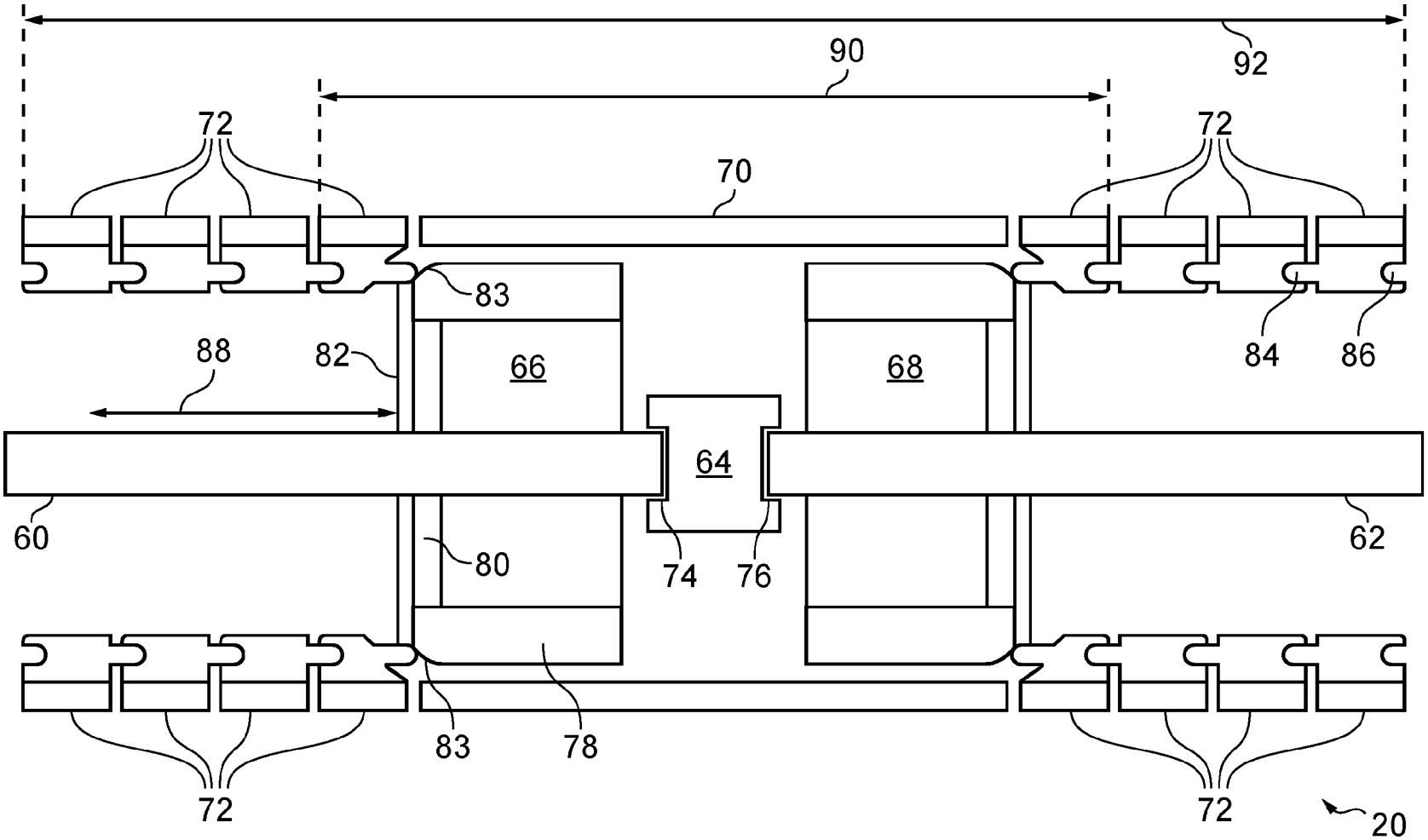
FIG. 6 illustrates a cross sectional side view of a first roller according to an example of the invention.

FIG. 6 illustrates a cross sectional side view of a first roller 20. The first roller 20 illustrated in FIG. 6 is arranged to have a variable diameter along a portion of the width of the first roller 20. The first roller 20 includes a first lead screw 60, a second lead screw 62, a support 64 for the first lead screw 60 and the second lead screw 62, a first actuator 66, a second actuator 68, a cover 70 and a plurality of cover members 72.

The first lead screw 60 and the second lead screw 62 extend axially along the centre of the first roller 20. The first lead screw 60 and the second lead screw 62 are coupled to the distribution shaft 42 via an electromagnetic clutch which is arranged to selectively couple the distribution shaft 42 to the drive shaft 44 or to the first and second lead screws 60, 62.

The support 64 is positioned at the centre of the first roller 20 and includes a first cavity 74 for receiving an end of the first lead screw 60 and a second cavity 76 for receiving an end of the second lead screw 62. The first and second cavities 74, 76 are dimensioned to enable the first and second lead screws 60, 62 to rotate without causing the support 64 to rotate.

The first actuator 66 includes a slider 78, a nut 80, and a flange 82. The slider 78 is tubular in shape and has a wedge-shaped end 83. The first lead screw 60 extends through the centre of the slider 78. The nut 80 is positioned within the slider 78 and is fixed to an inside surface of the slider 78. The flange 82 is positioned at the end of the slider 78 adjacent the wedge shaped end 83.

The cover 70 defines an exterior surface of the first roller 20 and is positioned in the axial centre of the first roller 20.

The plurality of cover members 72 are positioned adjacent the ends of the cover 70 and define an exterior surface of the first roller 20. It should be appreciated that for an axial position along the first roller 20, there is a plurality of cover members 72 that form an annulus. A cover member 72 includes a protrusion 84 that extends in the axial direction and a cavity 86 that also extends into the cover member 72 in the axial direction. The plurality of cover members 72 are arranged in series so that a protrusion 84 of a cover member 72 extends into the cavity 86 of an adjacent cover member 72. This coupling between adjacent cover members 72 forms a hinge and enables adjacent cover members 72 to pivot relative to one another.

In operation, the first lead screw 60 may be rotated and since the nut 80 is fixed to the slider 66, the nut 80 does not rotate with the first lead screw 60 and instead, the slider 78 moves axially left or right along the first lead screw 60 (depending on the direction of rotation of the lead screw) as indicated by the arrow with reference numeral 88. As the slider 78 moves towards the plurality of cover members 72 (that is, to the left), the wedge shaped end 83 of the slider 78 pushes the adjacent cover members 72 radially outwards, thereby increasing the diameter of the first roller 20. As the slider 78 continues to moves to the left, the slider 78 sequentially pushes the cover members 72 radially outwards. The second actuator 68 has a similar structure to the first actuator 66 and operates in the same manner as the first actuator 66.

The portion of first roller 20 that has an increased diameter forces contact between the continuous belt 23 and the second roller 27 and consequently, the roller 20 illustrated in FIG. 6 is arranged to provide an adjustable width of the continuous belt 23 to the second roller 27. For example, where the first and second actuators 66, 68 force the cover members 72 adjacent the cover 70 radially outwards, the first roller 20 forces contact between the continuous belt 23 and the second roller 27 along the width indicated by reference numeral 90. By way of another example, where the first and second actuators 66, 68 forces all of the plurality of cover members 72 radially outwards, the first roller 20 forces contact between the continuous belt 23 and the second roller 27 along the width indicated by reference numeral 92 (which is greater than the width 90).

The operation of the printing system 10 is described in the following paragraphs with reference to FIGS. 7 and 8.

Figure 7:
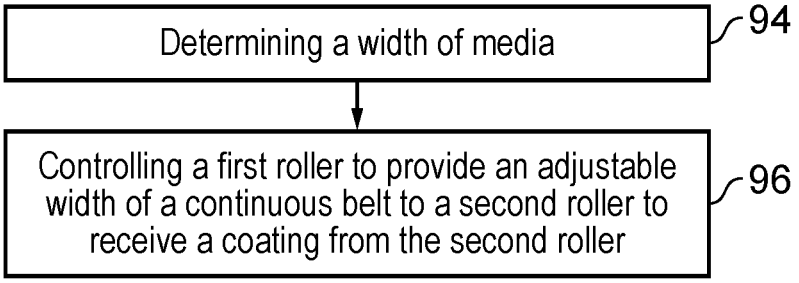
FIG. 7 illustrates a flow diagram of a method according to an example of the invention.

FIG. 7 illustrates a flow diagram of a method. At block 94, the method includes determining a width of media 12. For example, the sensor 24 may determine the width of the media 12 and provide the sensed width to the controller 18. The controller 18 subsequently determines the width of the media 12 from the sensed width received from sensor 24. By way of another example, a user may manipulate the user input device 26 to input information indicative of the width of the media 12. The user input device 26 subsequently provides the information to the controller 18 which then determines the width of the media 12 from the information.

At block 96, the method includes controlling the first roller 20 to provide a width of the continuous belt 23 (corresponding to the determined width in step 94) to the second roller 27 to receive a coating from the second roller 27. It should be appreciated that the width of the continuous belt 23 to be provided to the second roller 27 may be substantially the same as the width of the media 12. Alternatively, the width of the continuous belt 23 to be provided to the second roller 27 may be less than the width of the media 12 by an amount (for example, so that coating applied to the media 12 by the second roller 27 does not extend into the side margins of the media 12).

Figure 8:
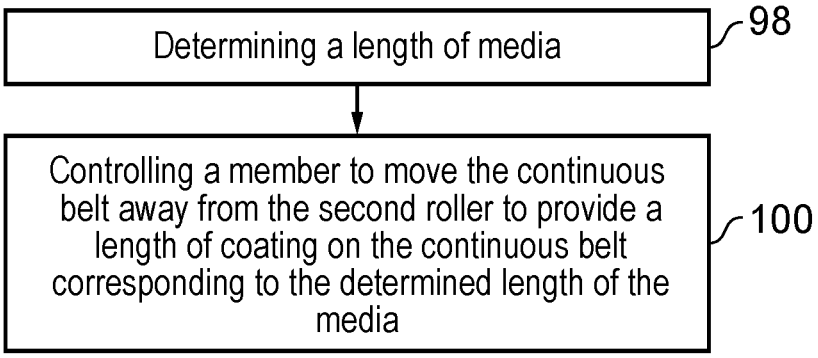
FIG. 8 illustrates a flow diagram of another method according to an example of the invention.

FIG. 8 illustrates a flow diagram of another method. At block 98, the method includes determining a length of media 12. For example, the sensor 24 may determine the length of the media 12 and provide the sensed length to the controller 18. The controller 18 subsequently determines the length of the media 12 from the sensed length received from sensor 24. By way of another example, a user may manipulate the user input device 26 to input information indicative of the length of the media 12. The user input device 26 subsequently provides the information to the controller 18 which then determines the length of the media 12 from the information.

At block 100, the method includes controlling the member 52 to move the continuous belt 23 away from the second roller 27 to provide a length of coating on the continuous belt 23 corresponding to the determined length of the media 12. It should be appreciated that the length of coating applied to the continuous belt 23 may be substantially the same as the length of the media 12. Alternatively, the length of coating applied to the continuous belt 23 may be less than the length of the media 12 by an amount (for example, so that coating applied to the media 12 by the second roller 27 does not extend into the top and bottom margins of the media 12).

Next, the media 12 is inserted into the apparatus 14, 141 in the direction of the arrow indicated by reference numeral 102 (as illustrated in FIGS. 3 and 5). The media 12 moves between the continuous belt 23 and the impression drum 38 and receives coating from the continuous belt 23. The media 12 is then provided to the printing unit 16 so that ink or toner may be applied to the media 12 over the layer of coating.

Various examples of the invention provide several advantages and at least some of these are mentioned in the following paragraphs.

Firstly, since the dimensions of coating applied to media 12 may be substantially the same as (or less than) the dimensions of the media 12, the apparatus 14, 141 (and hence printing system 10) may be used to coat media having different dimensions. This may enable the printing system 10 to only include a single apparatus for applying a layer of coating to media.

Secondly, since the apparatus 14, 141 may include a controller 18, the apparatus 14, 141 may be a fully automated system and may not require human intervention to operate. Furthermore, the apparatus 14, 141 may require relatively low maintenance to operate. This may help to reduce the operating costs of the apparatus 14, 141 and hence printing system 10.

Thirdly, since the apparatus 14, 141 is relatively compact, the apparatus 14, 141 advantageously provides a low space consumption unit and may not significantly increase the space occupied by the printing system 10.

Fourthly, since the width of the continuous belt 23 may be relatively large (for example, the width of the continuous belt 23 may be the same or larger than the width of the media 12), the media 12 may be moved by the continuous belt 23 without being buckled or side shifted that would later affect print quality if present.

The blocks illustrated in the FIGS. 7 and 8 may represent steps in a method and/or sections of code in the computer program 32. The illustration of a particular order to the blocks does not necessarily imply that there is a required or preferred order for the blocks and the order and arrangement of the block may be varied. Furthermore, it may be possible, in some examples, for some blocks to be omitted.

Although examples of the present invention have been described in the preceding paragraphs with reference to various examples, it should be appreciated that modifications to the examples given can be made without departing from the scope of the invention as claimed. For example, a user may physically manipulate the first roller 20 so that the first roller 20 provides a desired width of the continuous belt 23 to the second roller 27. In these examples, the apparatus 14 may not require a controller 18 or an actuator for manipulating the first roller 20 to change shape.

Features described in the preceding description may be used in combinations other than the combinations explicitly described.

Although functions have been described with reference to certain features, those functions may be performable by other features whether described or not.

Although features have been described with reference to certain examples, those features may also be present in other examples whether described or not.

Whilst endeavoring in the foregoing specification to draw attention to those features of the invention believed to be of particular importance it should be understood that the Applicant claims protection in respect of any patentable feature or combination of features hereinbefore referred to and/or shown in the drawings whether or not particular emphasis has been placed thereon.

The invention claimed is:

1. An apparatus to apply a coating to a media, comprising:

a first roller to receive a continuous belt that is to receive the coating from a second roller and to transfer the coating to the media, the first roller having a variable dimension to provide an adjustable width of the continuous belt to the second roller;

a member to move the continuous belt away from the second roller to prevent the coating being applied to the continuous belt by the second roller; and a controller to determine a length of the media and to control the member to move the continuous belt away from the second roller to provide a length of the coating on the continuous belt corresponding to the determined length of the media.

2. The apparatus of claim 1, wherein the first roller is adjustable in diameter along at least a portion of the first roller to provide the adjustable width of the continuous belt to the second roller.

3. The apparatus of claim 1, wherein the first roller is adjustable in width to provide the adjustable width of the continuous belt to the second roller.

4. The apparatus of claim 1, wherein the first roller comprises an actuator, and the apparatus further comprises a controller to control the actuator of the first roller to adjust the dimension of the first roller.

5. The apparatus of claim 4, wherein the first roller comprises a plurality of cover members defining an outer surface of the first roller, the plurality of cover members being moveable in a radial direction between an extended position and a collapsed position, and wherein the actuator is to move the cover members between the extended position and the collapsed position.

6. The apparatus of claim 5, wherein the actuator comprises a rotatable member that when rotated causes the plurality of cover members of the first roller to move.

7. The apparatus of claim 6, wherein the actuator further comprises a slider to slide along an axis in response to rotation of the rotatable member, the slider comprising a contact portion to push the plurality of cover members as the slider slides along the axis.

8. The apparatus of claim 1, wherein the coating comprises a primer.

9. The apparatus of claim 1, comprising a printing system that includes the first roller and the second roller.

10. The apparatus of claim 1, wherein the width of the continuous belt provided to the second roller is adjustable to correspond to a width of the media.

11. The apparatus of claim 1, wherein the member comprises a blade.

* * * * *